US011463813B2

(12) United States Patent
Winton et al.

(10) Patent No.: US 11,463,813 B2
(45) Date of Patent: Oct. 4, 2022

(54) ASYMMETRIC ACOUSTICAL IMPLEMENTATION FOR IMPROVING A LISTENING EXPERIENCE FOR A DRIVER IN A VEHICLE

(71) Applicant: HARMAN INTERNATIONAL INDUSTRIES, INCORPORATED, Stamford, CT (US)

(72) Inventors: Riley Winton, Opelika, AL (US); Christopher Ludwig, Bloomfield Hills, MI (US); Brian Sterling, Farmington Hills, MI (US); Arndt Hensgens, Stamford, CT (US)

(73) Assignee: Harman International Industries, Incorporated, Stamford, CT (US)

( * ) Notice: Subject to any disclaimer, the term of this patent is extended or adjusted under 35 U.S.C. 154(b) by 52 days.

(21) Appl. No.: 16/957,440

(22) PCT Filed: Dec. 22, 2018

(86) PCT No.: PCT/IB2018/060553
§ 371 (c)(1),
(2) Date: Jun. 24, 2020

(87) PCT Pub. No.: WO2019/130206
PCT Pub. Date: Jul. 4, 2019

(65) Prior Publication Data

US 2021/0076139 A1 Mar. 11, 2021

Related U.S. Application Data

(60) Provisional application No. 62/612,072, filed on Dec. 29, 2017.

(51) Int. Cl.
*H04R 5/04* (2006.01)
*H04R 3/00* (2006.01)
(Continued)

(52) U.S. Cl.
CPC ..... *H04R 5/04* (2013.01); *H04R 1/025* (2013.01); *H04R 3/007* (2013.01); *H04R 5/02* (2013.01);
(Continued)

(58) Field of Classification Search
CPC ..... H04R 5/04; H04R 1/025; H04R 3/007; H04R 5/02; H04R 29/001; H04R 2499/13; H04S 7/30
See application file for complete search history.

(56) References Cited

U.S. PATENT DOCUMENTS

| | | | |
|---|---|---|---|
| 9,362,878 | B1 | 6/2016 | Su |
| 2011/0081032 | A1 | 4/2011 | Soulodre |
| 2017/0048606 | A1 | 2/2017 | Fan et al. |

FOREIGN PATENT DOCUMENTS

| | | | |
|---|---|---|---|
| EP | 0766495 | A2 | 2/1997 |
| EP | 2369852 | A1 | 9/2011 |

OTHER PUBLICATIONS

Translation of EP0766495A2, Ritter, "Arrangement for Reproducing a Plurality of Acoustic Signal Sources in an Enclosed Space", Apr. 2, 1997 (Year: 1997).*
(Continued)

*Primary Examiner* — Mark Fischer
(74) *Attorney, Agent, or Firm* — Brooks Kushman P.C.

(57) ABSTRACT

In at least one embodiment, an audio system is provided. The audio system includes a first loudspeaker, a second loudspeaker, and an audio controller. The first loudspeaker is positioned on first side of a vehicle to transmit a first audio signal to a driver. The second loudspeaker is positioned on a second side of the vehicle to transmit a second audio signal to a passenger. The audio controller is configured to increase an audio experience for only the driver of the vehicle by at least one of controlling a voltage provided to the first loudspeaker to cause a first overall excursion of the first
(Continued)

loudspeaker to be greater than a second overall excursion of the second loudspeaker, and limiting an amount of current that is delivered only to the first loudspeaker to prevent the first loudspeaker from temporarily shutting down due to an overcurrent condition.

20 Claims, 3 Drawing Sheets

(51) Int. Cl.

| | |
|---|---|
| ***H04R 1/02*** | (2006.01) |
| ***H04R 5/02*** | (2006.01) |
| ***H04R 29/00*** | (2006.01) |
| ***H04S 7/00*** | (2006.01) |

(52) U.S. Cl.
CPC ..... *H04R 29/001* (2013.01); *H04S 7/30* (2013.01); *H04R 2499/13* (2013.01)

(56) References Cited

OTHER PUBLICATIONS

PCT International Search Report and Written Opinion, PCT/IB2018/060553 dated Mar. 29, 2019, 15 pages.
Office Action for Chinese Application No. 201880083496.X filed Jun. 23, 2020, dated Jul. 2, 2021, 9 pgs.
European Office Action for EP Application No. 18842848.6 filed Dec. 22, 2018, dated Jan. 27, 2022, 7 pgs.
English Translation of Second Chinese Office Action dated Mar. 3, 2022 for Chinese Application No. 201880083496.X filed Dec. 22, 2018, 8 pgs.

* cited by examiner

ASYMMETRIC ACOUSTICAL IMPLEMENTATION FOR IMPROVING A LISTENING EXPERIENCE FOR A DRIVER IN A VEHICLE

CROSS-REFERENCE TO RELATED APPLICATION

This application is the U.S. National Phase of PCT Appln. No. PCT/IB2018/060553, filed on Dec. 22, 2018, and entitled ASYMMETRIC ACOUSTICAL IMPLEMENTATION FOR IMPROVING A LISTENING EXPERIENCE FOR A DRIVER IN A VEHICLE", which claims the benefit of U.S. Provisional Application Ser. No. 62/612,072, filed on Dec. 29, 2017, the disclosures of which are hereby incorporated by reference in their entirety.

TECHNICAL FIELD

Aspects disclosed herein generally provide for an asymmetric acoustical implementation for improving a listening experience for a driver in a vehicle.

BACKGROUND

Various audio and speaker related manufacturers are well equipped in providing high-performance audio related products for vehicles. However, such audio and speaker related manufacturers recognize that there are ample growth opportunities in entry level market audio systems. Further, the audio and speaker related manufactures certainly don't intend to damage their respective brands or reputation by producing poor audio sound systems. The audio and speaker related manufacturers are finding ways to compete price-wise while providing desirable acoustics.

SUMMARY

In at least one embodiment, an audio system is provided. The audio system includes a first loudspeaker, a second loudspeaker, and an audio controller. The first loudspeaker is positioned on first side of a vehicle to transmit a first audio signal to a driver. The second loudspeaker is positioned on a second side of the vehicle to transmit a second audio signal to a passenger. The audio controller is configured to increase an audio experience for only the driver of the vehicle by at least one of controlling a voltage provided to the first loudspeaker to cause a first overall excursion of the first loudspeaker to be greater than a second overall excursion of the second loudspeaker, and limiting an amount of current that is delivered only to the first loudspeaker to prevent the first loudspeaker from temporarily shutting down due to an overcurrent condition.

In at least another embodiment, an audio system is provided. The audio system includes a first loudspeaker, a second loudspeaker, and an audio controller. The first loudspeaker may be positioned on first side of a vehicle to transmit a first audio signal to a driver of the vehicle. The second loudspeaker may be positioned on a second side of the vehicle to transmit a second audio signal to a passenger of the vehicle. The audio controller is configured to provide a first voltage to the first loudspeaker that coincides with a first overall excursion of the first loudspeaker while transmitting the first audio signal to the driver and to provide a second voltage to the second loudspeaker that coincides with a second overall excursion of the second loudspeaker while transmitting the second audio signal to the passenger. The first voltage is greater than the second voltage such that the first overall excursion of the first loudspeaker is greater than the second overall excursion of the second loudspeaker thereby enabling the driver to experience an increased audio experience than that of the passenger.

In at least one embodiment, an audio system is provided. The audio system includes a first loudspeaker, a second loudspeaker, and an audio controller. The first loudspeaker may be positioned on first side of a vehicle to transmit a first audio signal to a driver of the vehicle. The second loudspeaker may be positioned on a second side of the vehicle to transmit a second audio signal to a passenger of the vehicle. The audio controller is configured to limit an amount of current that is provided only for the first loudspeaker to prevent the first loudspeaker from temporarily shutting down due to an overcurrent condition thereby enabling the driver to experience an increased audio experience than that of the passenger.

BRIEF DESCRIPTION OF THE DRAWINGS

The embodiments of the present disclosure are pointed out with particularity in the appended claims. However, other features of the various embodiments will become more apparent and will be best understood by referring to the following detailed description in conjunction with the accompany drawings in which:

DETAILED DESCRIPTION

Figure 2:
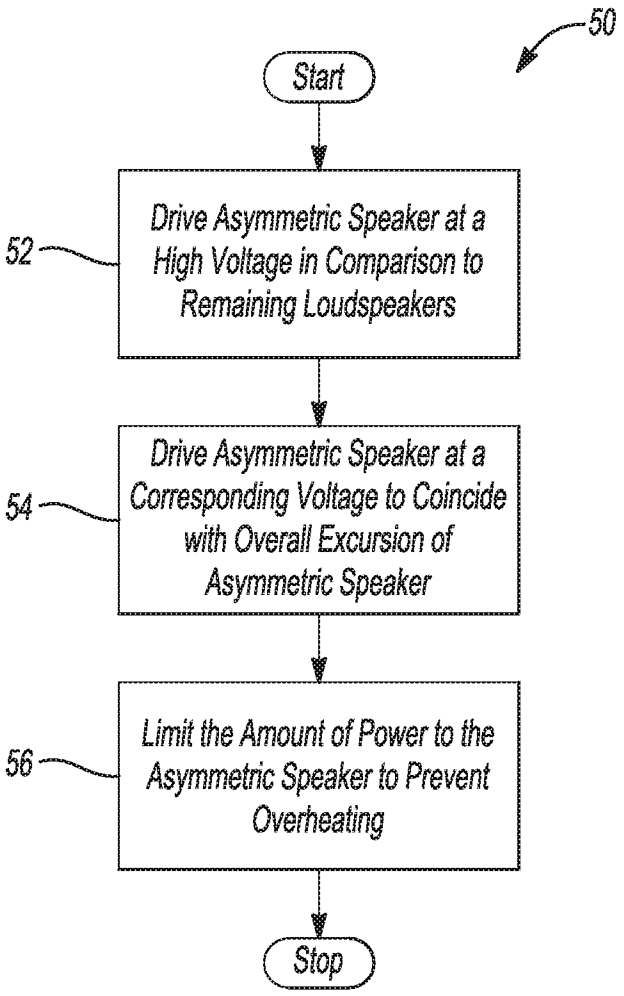
FIG. 2 generally depicts a method for controlling an asymmetric loudspeaker in a vehicle in accordance to one embodiment.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

The embodiments of the present disclosure generally provide for a plurality of circuits or other electrical devices. All references to the circuits and other electrical devices and the functionality provided by each are not intended to be limited to encompassing only what is illustrated and described herein. While particular labels may be assigned to the various circuits or other electrical devices disclosed, such labels are not intended to limit the scope of operation for the circuits and the other electrical devices. Such circuits and other electrical devices may be combined with each other and/or separated in any manner based on the particular type of electrical implementation that is desired. It is recognized that any circuit or other electrical device disclosed herein may include any number of microcontrollers, a graphics processor unit (GPU), integrated circuits, memory devices (e.g., FLASH, random access memory (RAM), read only memory (ROM), electrically programmable read only memory (EPROM), electrically erasable programmable read only memory (EEPROM), or other suitable variants thereof) and software which co-act with one another to perform operation(s) disclosed herein. In addition, any one or more of the electrical devices may be configured to execute a computer-program that is embodied in a non-transitory computer readable medium programmed to perform any number of the functions as disclosed.

Aspects disclosed herein generally provide for an asymmetric acoustical implementation for improving a listening experience for a driver in a vehicle. The asymmetric acoustical implementation may provide an economical upgrade to an entry-level based audio equipped vehicle. For example, instead of using acoustically matched pairs of loudspeakers, one loudspeaker of a corresponding pair may include upgraded acoustic performance capabilities (e.g., the asymmetric loudspeaker) over the other loudspeaker of the pair. This implementation yields an acoustical asymmetrical experience. In addition, the asymmetric loudspeaker approach may be incorporated in a front row of the vehicle and the corresponding loudspeaker with the enhanced acoustic output capabilities (e.g., the asymmetric loudspeaker) may be orientated in the vehicle to transmit audio therefrom to enable a driver of the vehicle to enjoy the enhanced audio playback attributed to the increased audio capability of the asymmetric loudspeaker.

Figure 1:
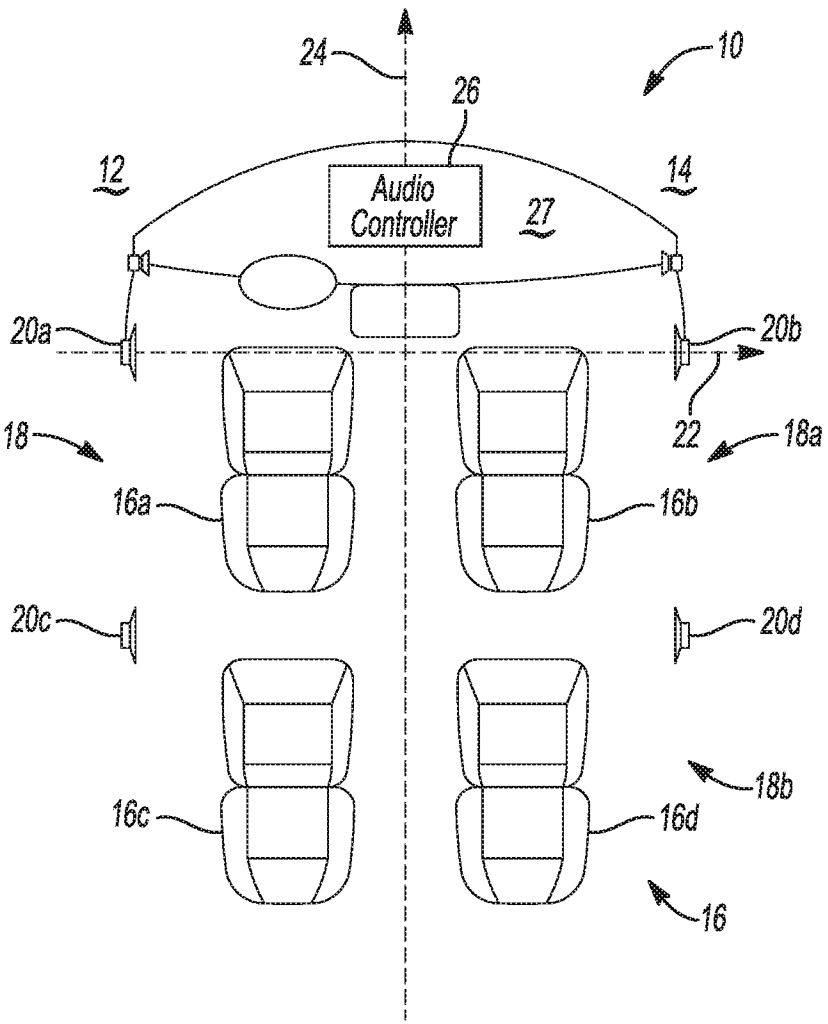
FIG. 1 generally depicts a vehicle audio system in accordance to one embodiment.

FIG. 1 generally depicts an audio system 10 in a listening environment 12 of a vehicle 14 in accordance to one embodiment. The listening environment 12 includes a plurality of seats 16 (e.g., a first seat 16*a*, a second seat 16*b*, a third seat 16*c*, and a fourth seat 16*d*) positioned in rows 18 (e.g. a first row 18*a* and a second row 18*b*) of the vehicle 14. It is recognized that the number of seats 16 and rows 18 in the vehicle 14 may vary based on the particular implementation of the vehicle 14. The first seat 16*a* is substantially adjacent to the second seat 16*b*. The first seat 16*a* may be a driver seat, and the second seat 16*b* may be a front passenger seat. The third seat 16*c* may be a left rear passenger seat, and the fourth seat 16*d* may be a right rear passenger seat. As illustrated, the first seat 16*a* and the second seat 16*b* may be substantially aligned in the first row 18*a*. The second row 18*b* is generally positioned behind the first row 18*a* in the vehicle 14.

The vehicle 14 includes a plurality of loudspeakers 20 (e.g., a first loudspeaker 20*a*, a second loudspeaker 20*b*, a third loudspeaker 20*c*, and a fourth loudspeaker 20*d*) positioned within the listening environment 12. The first loudspeaker 20*a* may be proximal to the first seat 16*a* and distal to the second seat 16*b*. The second loudspeaker 20*b* may be proximal to the second seat 16*b* and distal to the first seat 16*a*. The first loudspeaker 20*a* may be located in a left-hand door (not shown) or positioned within a headrest (not shown) of the first seat 16*a*. The second loudspeaker 20*b* may be located in a right-hand door (not shown) or positioned within a headrest (not shown) of the second seat 16*b*. A first transverse axis 22 running from a left side of the vehicle 14 to the right side of the vehicle 14 may intersect the first loudspeaker 20*a* and the second loudspeaker 20*b*. The first transverse axis 22 may run perpendicular to a center line 24 of the vehicle 14.

Additionally or alternatively, the first loudspeaker 20*a* and the second loudspeaker 20*b* may be aligned on a first plane (not shown). The first plane may run perpendicular to a center plane of the vehicle 14. The centerline 24 may be located on the center plane. Additionally or alternatively, the first loudspeaker 20*a* may be located at a position that is a mirror location of the second loudspeaker 20*b*. The centerline 24 (and/or the center plane) may extend from a front of the vehicle 14 to the rear of the vehicle 14 and serve as the mirror line and/or mirror plane, respectively, for the first loudspeaker 20*a* and the second loudspeaker 20*b*. The orientation of the first loudspeaker 20*a* in the vehicle 14 may, therefore, be a mirrored orientation of the orientation of the second loudspeaker 20*b*. Generally speaking, the first loudspeaker 20*a* and the second loudspeaker 20*b* may each be positioned on a similar three-dimensional coordinate axis on each of the first door and the second door, respectively, to provide the mirrored orientation. Likewise, the third loudspeaker 20*c* and the fourth loudspeaker 20*d* may each be positioned on a similar three-dimensional coordinate axis on each of the third door and the fourth door, respectively, to provide the mirrored orientation.

An audio controller 26 is operably coupled to the loudspeakers 20. The audio controller 26 transmits an audio signal to the loudspeakers 20. The loudspeakers 20 playback audio data in the listening environment 12 in response to the audio signal. The audio controller 26 generally processes information used in connection with an AM radio, FM radio, satellite radio, navigation system, user interface, display, wireless communication with mobile devices via Bluetooth, WiFi or other wireless protocols, etc. An audio amplifier 27 is operably coupled to the audio controller 26. The audio amplifier 27 may be integrated with the audio controller 26. In another embodiment, the audio amplifier 27 may be positioned exterior to the audio controller 26. The audio amplifier 27 is generally configured to receive an audio output from the audio controller 26 and to amplify the amplitude for the audio output to a level that is adequate to driver the various loudspeakers 20. It is recognized that the audio controller 26 may generally include any number of hardware based processors and memory. The audio controller 26 may execute any number of software algorithms that are stored on the memory with the various hardware-based processors to provide surround sound, audio tuning, such as for gain, EQ, or any number of various audio adjustments to enhance the listening experience within the listening environment. The audio controller 26 may include any number of channels with each corresponding channel being coupled to a respective loudspeaker 20 via the audio amplifier 27 for transmitting the audio signal to the respective loudspeaker 20.

The second loudspeaker 20*b* as positioned in the front passenger door (or the second door) may be configured with enhanced acoustic output capabilities (or increased acoustic output capabilities) in comparison to the first loudspeaker 20*a* as positioned in the driver door or the doors in the vehicle 14. The second loudspeaker 20*b* is generally positioned at a predetermined distance away from the driver and therefore enables any corresponding audio processing effects to be optimally heard by the driver due to the distance being a certain distance away from the second loudspeaker 20*b*. In addition, the second loudspeaker 20*b* is situated in the door to provide optimal audio directivity to the driver. The audio transmitted by the first loudspeaker 20*a* may be too close to the driver and is generally arranged or situated in the door to provide optimal audio directivity to the passenger in the second seat 12*b*. It may be advantageous to increase the listening experience for the driver in the vehicle 14 with the second loudspeaker 20*b* that includes the increased audio output capabilities while at the same time utilizing decreased acoustic output capabilities associated with the first loudspeaker 20*a* (and the third and fourth loudspeakers 20*c* and 20*d*) that generally provides the audio output to a passenger (i.e., non-driver) to keep the overall cost of the audio system down. Some audio systems generally provide for a symmetric implementation that provides similar audio capabilities for the first loudspeaker 20*a* and the second loudspeaker 20*b* (or for all loudspeakers 20 positioned in corresponding doors of the vehicle 14). In this case, the acoustical experience for the driver and the passenger is similar to one another. However, the disclosed audio system 10 incorporates an asymmetric implementation in which the second loudspeaker 20*b* (or asymmetric loudspeaker 20*b*) provides the increased acoustic output capabilities in comparison to the acoustic output capabilities of the first loudspeaker 20*a*.

For example, the audio controller 26 may execute a voltage manager routine to drive the asymmetric loudspeaker 20*b* at a higher voltage for predetermined frequencies in comparison to the remaining loudspeakers 20*a*, 20*b*, and 20*c* in the vehicle 14. In this case, the driver may experience the predetermined frequencies in the audio output from the asymmetric loudspeaker 20*b*. In addition, the audio controller 26 may drive the asymmetric loudspeaker 20*b* at a corresponding voltage to coincide with an overall excursion capacity of the asymmetric loudspeaker 20*b* over a frequency range thereof to increase the excursion capabilities of the asymmetric loudspeaker 20*b*. Excursion is generally defined as the overall length that a cone of the asymmetric loudspeaker 20*b* linearly travels from its original resting position in response to a voltage.

The audio controller 26 may also execute a power manager routine to limit the amount of current provided to the asymmetric loudspeaker 20*b* to prevent overheating of the asymmetric loudspeaker 20*b*. For example, the audio controller 26 may store information corresponding to an overall impedance of the asymmetric loudspeaker 20*b* and control the amount of current provided to the asymmetric loudspeaker 20*b* to prevent overheating. The information related to the overall impedance of the asymmetric loudspeaker 20*b* may be stored in the audio controller 26 prior to or during installation of the audio controller 26 and/or the loudspeakers 20 in the vehicle 14. It is recognized that the asymmetric loudspeaker 20*b* may be implemented as a midrange and subwoofer. The above noted features correspond to the increased acoustic capabilities provided by the audio controller 26 and the asymmetric loudspeaker 20*b*. Various examples of the manner an increased excursion for a speaker is achieved and prevention of speaker over-heating (i.e., current control) is set forth in U.S. Pat. No. 8,194,869 to Mihelich et al. which is hereby incorporated by reference in its entirety.

With the symmetric implementation, a left loudspeaker that mirrors a right loudspeaker is selected such that the left and the right loudspeakers acoustics match (e.g., same frequency range, same efficiency, same material composition, etc.). Moreover, because of the mirroring, the left loudspeaker and the right loudspeaker are dimensionally identical. This allows the left loudspeaker and the right loudspeaker to be universal parts, as such the left loudspeaker may be replaced by the right loudspeaker (and vice versa). From the hardware arrangement, the left loudspeaker is symmetrically acoustic to the right loudspeaker. Again, with the symmetric implementation, the driver may have the same acoustical experience as passengers in the vehicle. This is attributed to the symmetrical arrangement of the loudspeakers and the symmetrical acoustics thereof.

However, with the asymmetric implementation as set forth herein, the asymmetric acoustics between the asymmetric loudspeaker 20*b* and the first loudspeaker 20*a*, the driver may experience a drastically different acoustical experience than the remaining passengers in the vehicle 14. Compared to the first loudspeaker 20*a*, the third loudspeaker 20*c*, and the fourth loudspeaker 20*d*, the asymmetric loudspeaker 20*b* may provide a better acoustical experience for driver in the vehicle 14 as opposed to that experienced by the vehicle passengers in the vehicle 14. Generally, in vehicles where one seat is occupied more frequently than another seat in the same row, such as the driver seat versus an adjacent passenger seat, the asymmetric arrangement may be desirable since this arrangement (e.g., the asymmetric loudspeaker 20*b*) includes increased acoustic output capabilities.

While the asymmetric loudspeaker 20*b* may include increased acoustic capabilities over the acoustic capabilities of the first loudspeaker 20*a*, the third loudspeaker 20*c*, and the fourth loudspeaker 20*d*, it is recognized that the asymmetric loudspeaker 20*b* may have similar dimensional properties with that of the first loudspeaker 20*a*, the third loudspeaker 20*c*, and/or the fourth loudspeaker 20*d*. For example, the asymmetric loudspeaker 20*b* may be substantially identical dimensionally to the first loudspeaker 20*a* particularly from a packaging, installation, and mounting perspective (i.e., installation of the speakers 20 into the various cavities of vehicle doors). This approach does not require for vehicle sheet metal to take on different cavity sizes that receive the various speakers 20 which reduces complexity for an original equipment manufacturer (OEM). In addition, this approach provides for a mirrored packaging approach for the sheet metal on each side of the center line 24 of the vehicle 14. Further, the mirrored packaging approach for the loudspeakers 20 in the vehicle 14 enable the use of universal mounting brackets that can be applied to either the asymmetric loudspeaker 20*b* and the first loudspeaker 20*a*. When the dimensions of the asymmetric loudspeaker 20*b* are significantly differ from the dimensions of the second loudspeaker 20*b*, such a difference increases the overall manufacturing and complexity for the OEM that may increase cost.

In one example, the asymmetric loudspeaker 20*b* may have a cone diameter of 6 inches, and the first loudspeaker 20*a* may also have a cone diameter of 6 inches. In addition, the asymmetric loudspeaker 20*b* may have a predetermined depth. In one example, the overall depth of the first loudspeaker 20*a* may be that same as the depth of the asymmetric loudspeaker 20*b*. In another example, the overall depth of the asymmetric loudspeaker 20*b* may the different than that of the asymmetric loudspeaker 20*b*.

FIG. 2 generally depicts a method 50 for controlling the asymmetric loudspeaker 20*b* in the vehicle 14 to provide increased acoustic output capabilities in accordance to one embodiment.

In operation 52, the audio controller 26 drives the asymmetric loudspeaker 20*b* at a high voltage in comparison to the remaining loudspeakers 20*a*, 20*c*, and 20*d*. In this case, the asymmetric loudspeaker 20*b* may provide for a fuller or richer gain of the audio signal at various frequencies based on the higher voltage.

In operation 54, the audio controller 26 drives the asymmetric loudspeaker 20*b* at a corresponding voltage to coincide with an overall excursion capacity of the asymmetric loudspeaker 20*b* over a frequency range thereof to increase the excursion capabilities of the asymmetric loudspeaker 20*b*. By maximizing the amount of excursion provided by the asymmetric loudspeaker 20*b*, the asymmetric loudspeaker 20*b* may provide a deeper bass for low frequency audio and may avoid a smeared or bloated low frequency output. In general, the asymmetric loudspeaker 20*b* may be arranged to provide greater excursion than that of the remaining loudspeakers 20*a*, 20*c*, and 20*d*. In one example, the remaining loudspeakers 20*a*, 20*c*, and 20*d* may not be arranged due to their construction (or mechanical properties) to provide the level of excursion in comparison to the excursion provided by the asymmetric loudspeaker 20*b*. For example, given that the asymmetric loudspeaker 20*b* may have mechanical properties to enable increased levels of excursion, the audio controller 20*b* drives the asymmetric loudspeaker 20*b* at the corresponding voltage to coincide with the overall excursion capacity of the asymmetric loudspeaker 20*b* to achieve the desired excursion. Thus, the audio controller 26 may drive the asymmetric loudspeaker 20*b* at a different voltage when compared to the voltage that is used to drive the remaining loudspeakers 20*a*, 20*c*, and 20*d*.

In operation 56, the audio controller 26 limits the amount of power that is delivered to the asymmetric loudspeaker 20*b* to prevent overheating of a voice coil of the asymmetric loudspeaker 20*b*. Excessive current may damage the asymmetric loudspeaker 20*b* or temporarily shut the asymmetric loudspeaker 20*b* down. The audio controller 26 may not have to limit the amount of power that is delivered to the remaining loudspeakers 20*a*, 20*c*, and 20*d* as these speakers 20*a*, 20*c*, and 20*d* may have different mechanical properties (or inferior mechanical or other performance properties) than that of the asymmetric loudspeaker 20*b*.

Figure 3:
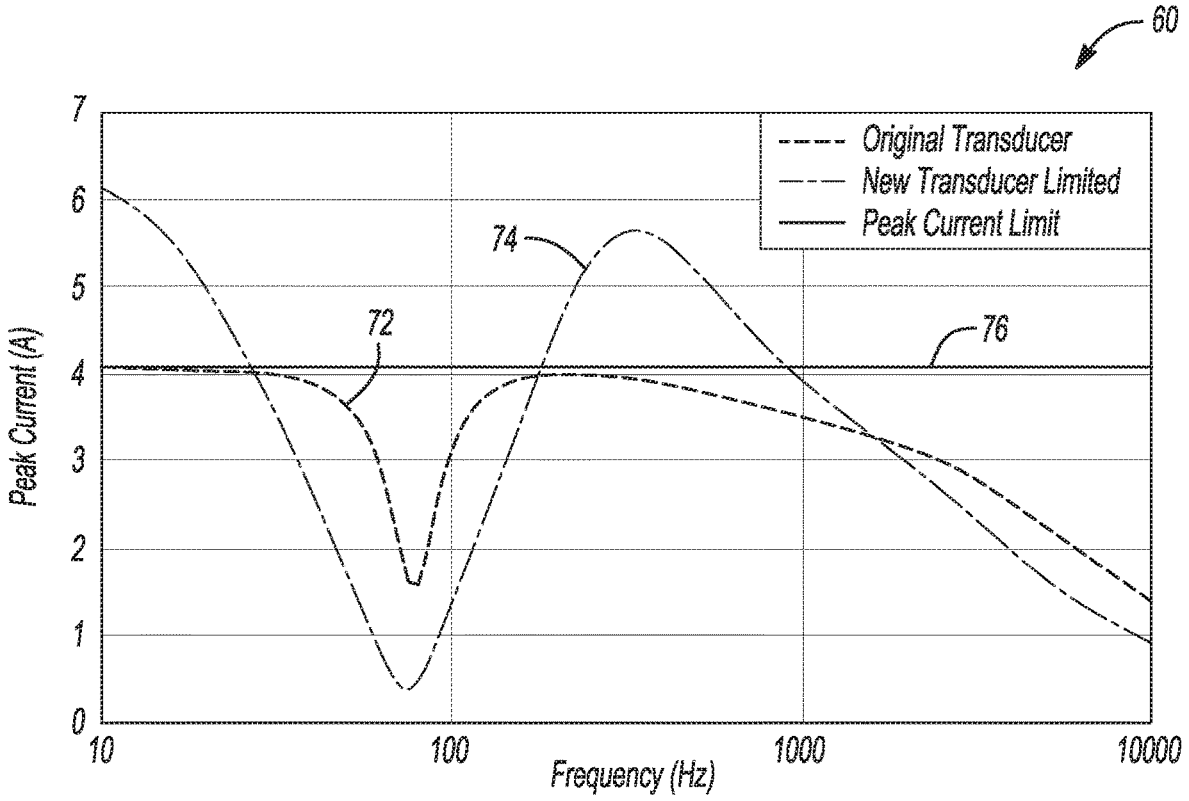
FIG. 3 generally depicts a plot corresponding to a peak current magnitude frequency response for an asymmetric loudspeaker that causes excessive current to be drawn from an amplifier.

FIG. 3 generally depicts a plot 70 corresponding to a peak current magnitude frequency response for loudspeakers 20 that cause excessive current to be drawn from an amplifier 27. The plot 70 generally depicts the manner in which excess current is present and the manner in which the asymmetric loudspeaker 20*b* is affected when the audio controller 26 does not execute the power manager routine to limit the amount of power provided to the asymmetric loudspeaker 20*b*. Waveform 72 generally corresponds to the peak current magnitude with respect to a frequency response for the first loudspeaker 20*a*. Waveform 74 generally corresponds to the peak current magnitude with respect to a frequency response for the asymmetric loudspeaker 20*b*. Waveform 76 generally corresponds to a peak current limit. As shown in FIG. 3, the peak current magnitude with respect to the frequency response for the asymmetric loudspeaker 20*b* exceeds the peak current limit 76 for various frequencies. The excess in peak current magnitude for the asymmetric loudspeaker 20*b* is generally attributed to the lower or reduced levels of impedance associated with the asymmetric loudspeaker 20*b*.

Figure 4:
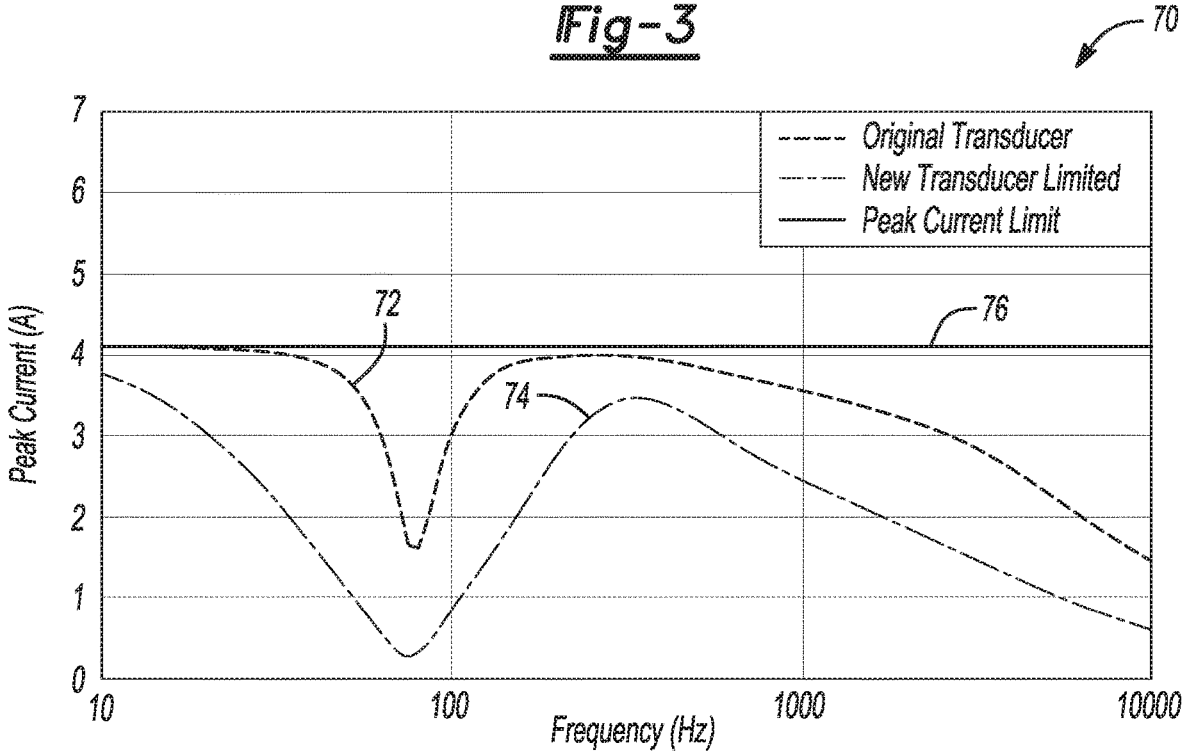
FIG. 4 generally depicts a plot corresponding to a peak current magnitude frequency response for the asymmetric loudspeaker that mitigates excessive current from being drawn from an amplifier in accordance to one embodiment.

Thus, when the audio controller 26 executes the power manager routine to limit the amount of power provided to the asymmetric loudspeaker 20*b*, this condition may mitigate the condition of the peak current for the asymmetric loudspeaker 20*b* exceeding the peak current limit 74. This condition is illustrated in plot 70 of FIG. 4. FIG. 4 also illustrates waveforms 72, 74, and 76. Due to the audio controller 26 executing the power manager routine, waveform 74 illustrates that the peak current magnitude over a frequency range (see waveform 74) does not exceed the peak current limit 76.

Generally speaking, it is possible to reduce the overall impedance of the asymmetric loudspeaker 20*b* to take advantage of a low peak voltage that is available for the asymmetric loudspeaker 20*b* (e.g., 14V peak, rated). The problem with reducing the impedance is that, over some frequency ranges, the reduced impedance may cause excessive current to be drawn from the amplifier 27. Excessive current draw may damage the amplifier 27 or at least cause the amplifier 27 to temporarily shut down which is not acceptable.

The audio controller 26 may also execute a power manager routine to limit the amount of current provided to the asymmetric loudspeaker 20*b* to prevent overheating of the asymmetric loudspeaker 20*b*. For example, the audio controller 26 may store information corresponding to an overall impedance of the asymmetric loudspeaker 20*b* and control the amount of current provided to the asymmetric loudspeaker 20*b* to prevent overheating. The information related to the overall impedance of the asymmetric loudspeaker 20*b* may be stored in the audio controller 26 prior to or during installation of the audio controller 26 and/or the loudspeakers 20 in the vehicle 14. Thus, in moments when it is expected that the overall impedance may be low for the asymmetric loudspeaker 20*b*, the audio controller 26 may limit the amount of current via the audio amplifier 27 that is provided to the asymmetric loudspeaker 20*b* to avoid exceeding the peak current limit 76. As shown in FIG. 4, the overall peak current for the asymmetric loudspeaker 20*b* is less than the overall peak current for the first loudspeaker 20*a*. This condition may prevent the asymmetric loudspeaker 20*b* from overheating.

Figure 5:
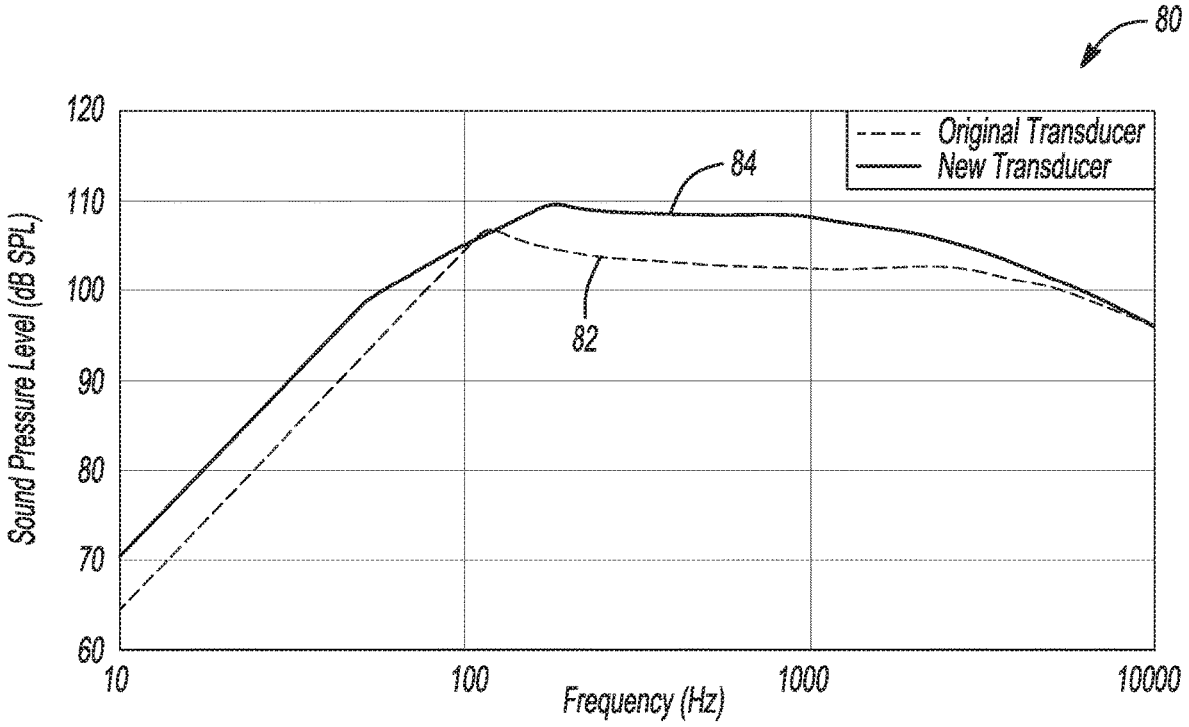
FIG. 5 generally depicts a plot corresponding to an increased excursion for the asymmetric loudspeaker in accordance to one embodiment.

FIG. 5 generally depicts a plot 80 corresponding to an increased excursion for the asymmetric loudspeaker 20*b* in accordance to one embodiment. Waveform 82 generally depicts a sound pressure level (SPL) over a frequency range for the first loudspeaker 20*a*. Waveform 84 generally depicts the SPL over the frequency range for the asymmetric loudspeaker 20*b*. As shown, waveform 84 exhibits an increase in SPL over the frequency range (i.e., for the asymmetric loudspeaker 20*b*) due in comparison to the SPL over the frequency range for the first loudspeaker 20*a*. This is attributed to the higher efficiency in excursion that takes place with the asymmetric loudspeaker 20*b* as opposed to the overall excursion of the first loudspeaker 20*a*.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An audio system comprising:

a first loudspeaker for being positioned on first side of a vehicle to transmit a first audio signal to a driver of the vehicle;

a second loudspeaker for being positioned on a second side of the vehicle to transmit a second audio signal to a passenger of the vehicle; and an audio controller configured to:

provide a first voltage to the first loudspeaker that coincides with a first overall excursion of the first loudspeaker while transmitting the first audio signal to the driver; and provide a second voltage to the second loudspeaker that coincides with a second overall excursion of the second loudspeaker while transmitting the second audio signal to the passenger, wherein the first voltage is greater than the second voltage such that the first overall excursion of the first loudspeaker is greater than the second overall excursion of the second loudspeaker thereby enabling the driver to experience an increased audio experience than that of the passenger.

2. The audio system of claim 1, wherein the audio controller is further configured to provide a third voltage to the first loudspeaker such that the first loudspeaker provides predetermined frequencies in the first audio signal thereby enabling the driver to experience the predetermined frequencies in the first audio signal.

3. The audio system of claim 2, wherein the audio controller is further configured to provide a fourth voltage to the second loudspeaker to transmit the second audio signal to the passenger, the third voltage being greater than the fourth voltage to enable only the driver to listen to the first audio signal at the predetermined frequencies.

4. The audio system of claim 1, wherein the audio controller is further configured to limit current only for the first loudspeaker to prevent the first loudspeaker from overheating or from temporarily shutting down.

5. The audio system of claim 1, wherein the first loudspeaker is positioned on a passenger side door of the vehicle to transmit the first audio signal to the driver.

6. The audio system of claim 5, wherein the second loudspeaker is positioned on a driver side door of the vehicle to transmit the second audio signal to the driver.

7. The audio system of claim 6, wherein the first loudspeaker and the second loudspeaker have the same size and shape as one another.

8. The audio system of claim 7, wherein the first loudspeaker and the second loudspeaker each transmit the first audio signal and the second audio signal in a same frequency range of one another.

9. The audio system of claim 1, wherein the vehicle defines a center line extending from a front of the vehicle to a rear of the vehicle to separate the first side of the vehicle from the second side of the vehicle.

10. The audio system of claim 9, wherein the first loudspeaker is positioned on a first location on the first side of the vehicle and the second loudspeaker is positioned on a second location on the second side of the vehicle such that the first loudspeaker is positioned in the vehicle symmetrically with the second loudspeaker in the vehicle.

11. An audio system comprising:

a first loudspeaker for being positioned on first side of a vehicle to transmit a first audio signal to a driver of the vehicle;

a second loudspeaker for being positioned on a second side of the vehicle to transmit a second audio signal to a passenger of the vehicle; and an audio controller configured to:

provide a first current to the first loudspeaker and a second current to the second loudspeaker; and limit the first current that is provided for the first loudspeaker to prevent the first loudspeaker from temporarily shutting down due to an overcurrent condition while continuing to provide the second current to the second loudspeaker, the audio controller limiting the first current to enable the driver to experience an increased audio experience than that of the passenger.

12. The audio system of claim 11, wherein the audio controller is further configured to:

provide a first voltage to the first loudspeaker that coincides with a first overall excursion of the first loudspeaker while transmitting the first audio signal to the driver; and provide a second voltage to the second loudspeaker that coincides with a second overall excursion of the second loudspeaker while transmitting the second audio signal to the passenger.

13. The audio system of claim 12, wherein the first voltage is greater than the second voltage such that the first overall excursion of the first loudspeaker is greater than the second overall excursion of the second loudspeaker.

14. The audio system of claim 11, wherein the first loudspeaker is positioned on a passenger side door of the vehicle to transmit the first audio signal to the driver.

15. The audio system of claim 14, wherein the second loudspeaker is positioned on a driver side door of the vehicle to transmit the second audio signal to the driver.

16. The audio system of claim 15, wherein the first loudspeaker and the second loudspeaker have the same size and shape as one another.

17. The audio system of claim 16, wherein the first loudspeaker and the second loudspeaker each transmit the first audio signal and the second audio signal in a same frequency range of one another.

18. The audio system of claim 11, wherein the vehicle defines a center line extending from a front of the vehicle to a rear of the vehicle to separate the first side of the vehicle from the second side of the vehicle.

19. The audio system of claim 18, wherein the first loudspeaker is positioned on a first location on the first side of the vehicle and the second loudspeaker is positioned on a second location on the second side of the vehicle such that the first loudspeaker is positioned in the vehicle symmetrically with the second loudspeaker in the vehicle.

20. An audio system comprising:

a first loudspeaker for being positioned on first side of a vehicle to transmit a first audio signal to a driver of the vehicle;

a second loudspeaker being dimensionally similar to the first loudspeaker and for being positioned on a second side of the vehicle to transmit a second audio signal to a passenger of the vehicle; and an audio controller configured to increase an audio experience for only the driver of the vehicle by:

controlling a voltage provided to the first loudspeaker to cause a first overall excursion of the first loudspeaker to be greater than a second overall excursion of the second loudspeaker, and limiting an amount of current that is delivered only to the first loudspeaker to prevent the first loudspeaker from temporarily shutting down due to an overcurrent condition.

* * * * *